US009593904B2

(12) United States Patent
Naki

(10) Patent No.: US 9,593,904 B2
(45) Date of Patent: Mar. 14, 2017

(54) BOW CENTER SHOT CALIBRATION DEVICE

(71) Applicant: Beck Enterprise LLC, Pearl City, HI (US)

(72) Inventor: Barney Naki, Pearl City, HI (US)

( * ) Notice: Subject to any disclaimer, the term of this patent is extended or adjusted under 35 U.S.C. 154(b) by 332 days.

(21) Appl. No.: 14/160,514

(22) Filed: Jan. 21, 2014

(65) Prior Publication Data

US 2014/0366860 A1 Dec. 18, 2014

Related U.S. Application Data

(60) Provisional application No. 61/835,577, filed on Jun. 15, 2013.

(51) Int. Cl.

| | |
|---|---|
| ***F41B 5/00*** | (2006.01) |
| ***G01B 3/30*** | (2006.01) |
| ***F41B 5/14*** | (2006.01) |
| *F41G 1/54* | (2006.01) |

(52) U.S. Cl.

CPC ..... *F41B 5/148* (2013.01); *F41G 1/545* (2013.01)

(58) Field of Classification Search

CPC ..... F41B 5/1476; F41B 5/148; F41G 1/545; G09B 19/02; G09B 19/24; G09B 23/02; G09B 1/02; G01B 3/004; G01B 3/06

See application file for complete search history.

(56) References Cited

U.S. PATENT DOCUMENTS

| | | | | |
|---|---|---|---|---|
| 3,088,212 A * | 5/1963 | Smith | F41B 5/14 | 124/23.1 |
| 3,111,772 A * | 11/1963 | Hartog | F41B 5/14 | 33/506 |
| 3,600,814 A * | 8/1971 | Smith | F41H 5/14 | 124/23.1 |
| 3,651,578 A * | 3/1972 | Saunders | F41H 5/14 | 124/23.1 |
| 4,382,339 A * | 5/1983 | Saunders | G01B 5/0023 | 33/265 |
| 4,594,786 A * | 6/1986 | Rezmer | G01B 5/0023 | 33/265 |
| 4,911,137 A * | 3/1990 | Troncoso | F41B 5/1438 | 124/86 |
| 5,175,937 A * | 1/1993 | Emerson, III | F41B 5/143 | 124/88 |
| 5,351,407 A * | 10/1994 | Van Drielen | F41B 5/14 | 33/265 |

(Continued)

*Primary Examiner* — Melba Bumgarner
*Assistant Examiner* — Amir Klayman
(74) *Attorney, Agent, or Firm* — Leighton K. Chong

(57) ABSTRACT

A conveniently portable archery device and a method for calibrating the center shot of a bow using the outer sidewall of a riser as a reference point, and without requiring attachment of the device to the bow. The device may easily and quickly allow the transverse position of the bow string to be marked, and also allow the position of the arrow rest to be adjusted so that an arrow may be correctly centered along its length with respect to the bowstring for more accurate firing. In one embodiment, the device is an improvement of a bow square article that in addition to being used to measure the nock point and brace height, equalize the tiller distances, and measure the peep sight, may also assist in calibrating center shot.

3 Claims, 13 Drawing Sheets

(56) References Cited

U.S. PATENT DOCUMENTS

| | | | | |
|---|---|---|---|---|
| 5,353,511 | A * | 10/1994 | Boll | F41B 5/14 124/24.1 |
| 6,526,666 | B1 * | 3/2003 | Lastinger, Jr. | F41B 5/14 124/87 |
| 2005/0239023 | A1 * | 10/2005 | Watanabe | G09B 19/02 434/188 |

* cited by examiner

BOW CENTER SHOT CALIBRATION DEVICE

BACKGROUND OF THE PRIOR ART

Optimum performance of a bow requires accurate calibration of the various bow components. For example, to ensure bow accuracy, the center shot of a bow is most often calibrated by aligning an arrow placed on an arrow rest in a straight line with the bow string, from where the nock pointing is set. When properly aligned, a center shot allows the energy stored in the limbs of the bow to be transferred down the core of the full length of the arrow shaft, thereby resulting in straight flight. Many methods and tools have been created for centering an arrow to a bow, but all have certain disadvantages.

A common and well-known trial-and-error method for centering an arrow to a bow involves shooting one unfletched arrow, and two or more fletched arrows from the bow, and then observing the difference in orientation of the shot arrows in the archery target. The archer then adjusts the position of the arrow rest accordingly, and repeats the process until the arrows group in the target with the same vertical orientation—a time-consuming and error-prone process.

Another method for centering an arrow to the bow string consists of hanging a bow upside down with the string facing upwards, nocking an arrow on the string, allowing gravity to pull the arrow towards the ground, and then aligning the arrow rest with the position of the downward-facing arrow. Once the arrow rest is adjusted in this manner, the arrow is fired to test accuracy, and the process is also repeated until the archer is satisfied with the grouping of the arrows. This method may not only be time-consuming but also depends on the ability of the archer to manually hold the bow still.

A third potentially inaccurate method for centering an arrow to a bow consists of making two marks in the bow, one in the center of the top limb, and another in the center of the bottom limb. The string is then lined up to the top and bottom line, while at the same time moving the bow rest in or out from the riser until the arrow is aligned with the middle of string.

Similar to the aforementioned methods, some prior art arrow-centering tools may require a substantial amount of time to calibrate accurately, may be expensive to manufacture, and may not be conveniently portable, to name just a few disadvantages. For example, some arrow centering tools utilizing comparatively sophisticated (and relatively expensive) laser technology usually require that a laser be attached to the sight hole on the back side of the riser, require a power source, and may not be designed for optimal use in harsh environments. Some disadvantages of prior art arrow-centering tools are also highlighted by some currently-typical features of modern compound bows.

Thus, there exists a need for a tool for calibrating center shot that is conveniently portable, easy to use, and that allows an arrow to be centered in a relatively expeditious manner.

SUMMARY OF INVENTION

A conveniently portable archery device for calibrating the center shot of a bow in an expeditious manner without having to be attached to the bow using a sidewall of the bow's riser as a reference point, and without requiring being attached to the bow or the parts thereof. The device may have a first and a second side, perpendicular to one another, the second side comprising or being parallel to a transversely extended cross bar for taking measurements. The cross bar may comprise, in one embodiment, an aligning component for marking the transverse position of the bowstring, when the inside edge of the first side is placed flatly against the outer sidewall of the bow riser. Said aligning component may have several embodiments, such as scaled markings and/or a sliding bead, and/or a sliding bead with scaled markings along the cross bar. Said device may utilize said outer sidewall of the bow riser as a reference point because many modern compound bows have sidewalls that are substantially flat and straight in the desired orientation for center shot calibration purposes. Moreover, the evolution of compound bow designs over the years has led to various improvements that may have inadvertently resulted in the omission of certain features relied on by some prior art arrow-centering tools to function properly, thereby creating an even greater need for a convenient and effective new arrow centering device.

One such feature that is largely omitted from current compound bow designs is the cushion plunger. When an arrow is launched from the bow string, the force applied to the back of the arrow and the front of the arrow's initial resistance to forward motion can cause a back and forth bending of the arrow as it is in flight, which motion reduces accuracy. Unpredictable contact between the arrow and the bow as the arrow is released, such as from the fletching making contact with the arrow rest, can also contribute to this undesired, oscillatory motion. The cushion plunger may assist in countering the erratic effects of the undesired oscillatory motion. More specifically, the cushion plunger normally comprises a nob protruding from the arrow rest of many older compound bows, which adjusts springs inside the arrow rest for applying different amounts of tension against the arrow, thereby creating a more stiff or "dynamic" spine.

Instead of incorporating a cushion plunger feature, however, modern compound bow designs commonly include an arrow rest that falls away from the arrow upon the arrow's release, thus minimizing or avoiding contact with the fletching, thereby reducing the back and forth bending movement of the arrow in flight. This change in design, as well as other improvements to the materials comprising the bow that result in improved accuracy, have resulted in the omission of a cushion plunger from many compound bow designs. The omission of the cushion plungers and its corresponding hole, has rendered some prior art devices for centering an arrow to the bow, which requiring attaching to the bow via the cushion plunger hole, less advantageous, if not entirely obsolete. However, the sidewall of the riser of the modern compound bow, on the side of the riser opposite from the arrow rest, may be relatively flat and run in a plane oriented with the intended direction of the arrow's trajectory, and thus may provide a substantially accurate reference point for centering an arrow to the bow—without requiring any attaching whatsoever.

The device may be comprised of two members, a first member longer than the second. The inside edge of the longer/first member of the bow square may be configured so that it may be contact with the sidewall of a bow's riser in an even, stable manner. An aligning component along or parallel to the shorter/second member may be used to mark the transverse position of the bowstring. The bow square may then be rotated 180 degrees along the vertical axis, and the arrow rest may then be adjusted in order to align the arrow with the marked transverse position, centering the arrow to the bowstring.

To calibrate center shot, the inside edge of the long side of the device article may be placed flatly against the outer sidewall of the bow riser, and the cross bar may be used to mark the transverse position of the bowstring (using the aligning component in one the embodiment). The device may then be rotated roughly 180 degrees along the vertical axis (with the inside edge of the article still placed flatly against the side wall of the bow riser), so that the cross bar lies anterior to the arrow rest, with the cross bar substantially normal to the arrow, with the arrow nocked against the nocking point. The arrow rest may then be adjusted so that the arrow is aligned with the aligning component (which aligning component may be comprised of markings on the cross bar, or a sliding bead, or both, depending on the embodiment) of the cross bar. Accordingly, by using the sidewall of the riser as a reference point, instead of having to be attached to the bow, the device may be used to calibrate center shot.

In addition, an embodiment of the device may also be advantageously relatively lightweight and unburdensome to carry, features which may assist in providing an archer greater maneuverability when using a bow. Archers' preference for such maneuverability is evidenced by certain other changes in design of the compound bow over the years, such as shorter risers, holes carved into the risers, and stronger, lighter material such as carbon fiber replacing the aluminum risers and fiberglass limbs found in older versions of the compound bow. In accordance with archers' preference for being unhindered by the excess weight/unwieldiness of additional tools, an embodiment of the device may replace an archer's multi-calibration tool. More specifically, some such tools are colloquially known as "bow squares" due to two perpendicular axes, and may assist in tuning the nocking point, bracing height (or "fistmele"), and the tiller heights. However, such prior art bow square tools have largely been unable to assist in calibrating center shot. Thus, one embodiment of the device may comprise all the features of a bow square used to measure the nock point and brace height, and equalize the tiller distances, yet also comprise a cross bar as explained above for calibrating center shot. Thus, archers that already use or are inclined to use a bow square may use the bow square embodiment of the arrow-centering device without having to carry any separate tool.

Although embodiments of the device described herein have been designed for use with modern compound bow designs, it is contemplated that alternative embodiments may be adjusted and modified according to slight changes in bow designs in ways that will be apparent to those with ordinary skill in the relevant arts. Similarly, the precise configuration, dimensions, and measurement specifications of the article, such as the size and length of the first side and second side, whether or not the second side comprises the cross bar, the distance between the cross bar and the second side (in applicable embodiments, and the thickness/width of the inside edge of the first side, may of course vary in different embodiments. Furthermore, it is anticipated that embodiments of the article described herein may be basically L-shaped, or also come in different shapes, such as a "T," etc. The particular bow square embodiment described may comprise a "teardrop" shape at the corner of the bow square, yet many other shapes may be incorporated. Embodiments of the article can be used for bows designed for left-handed as well as right-handed artisans. Furthermore, although not specifically referenced above, it is anticipated that a bow square embodiment of the device may also be used to measure peep-sight.

Of course, it is also clearly anticipated that many embodiments of the device may not be a bow square, and may use any type of means for marking the transverse position of the bow string. For example, in one specific embodiment the position marking means may resemble a bead that may slide along the cross bar with grooves along the cross bar so that the bead may be held in place to mark a position. In said embodiment, said bead may come in many shapes and sizes and is only required to move along the cross bar. In another embodiment incorporating an aligning component, there may exist a means for tightening the aligning component to restrict movement so that the aligning component may be fixed in place once a position is marked. Other embodiments of the device may comprise different position marking means comprising scaled measurement markings. Although the second member of the particular embodiments shown in the drawing may comprise a cross bar, such a feature is hardly required for a position marking means and the second members of other embodiments may completely omit the cross bar feature. Other embodiments may include different "preset" markings, indicating (in the bow square embodiment) desired measurements for adjusting brace height, nocking point, tiller distances, and for centering an arrow to a particular bow, so that the adjustments can be made and/or verified quickly and accurately. Similarly, embodiments of the article may also contain such features known in art for recording and maintaining records of desired adjustments. The embodiment of the device described herein is not intended to be limited to use with a certain type of bow, but rather may be used with a variety of bows and components thereof.

The above description and listed alternative embodiments are considered that of some embodiments only. It is understood that the embodiments shown in the drawings and described above are merely for illustrative purposes and not intended to limit scope. Alterations and modifications of the device, and such further applications of the principles of the device as disclosed herein are contemplated as would occur to those skilled in the art to which the device article pertains.

BRIEF DESCRIPTION OF THE DRAWINGS

FIG. 2(*b*) shows a side perspective view of an embodiment of a device for centering an arrow to a bow, said device comprising a bow square having a position marking means comprising scaled measurement markings.

DESCRIPTION

Figure 1:
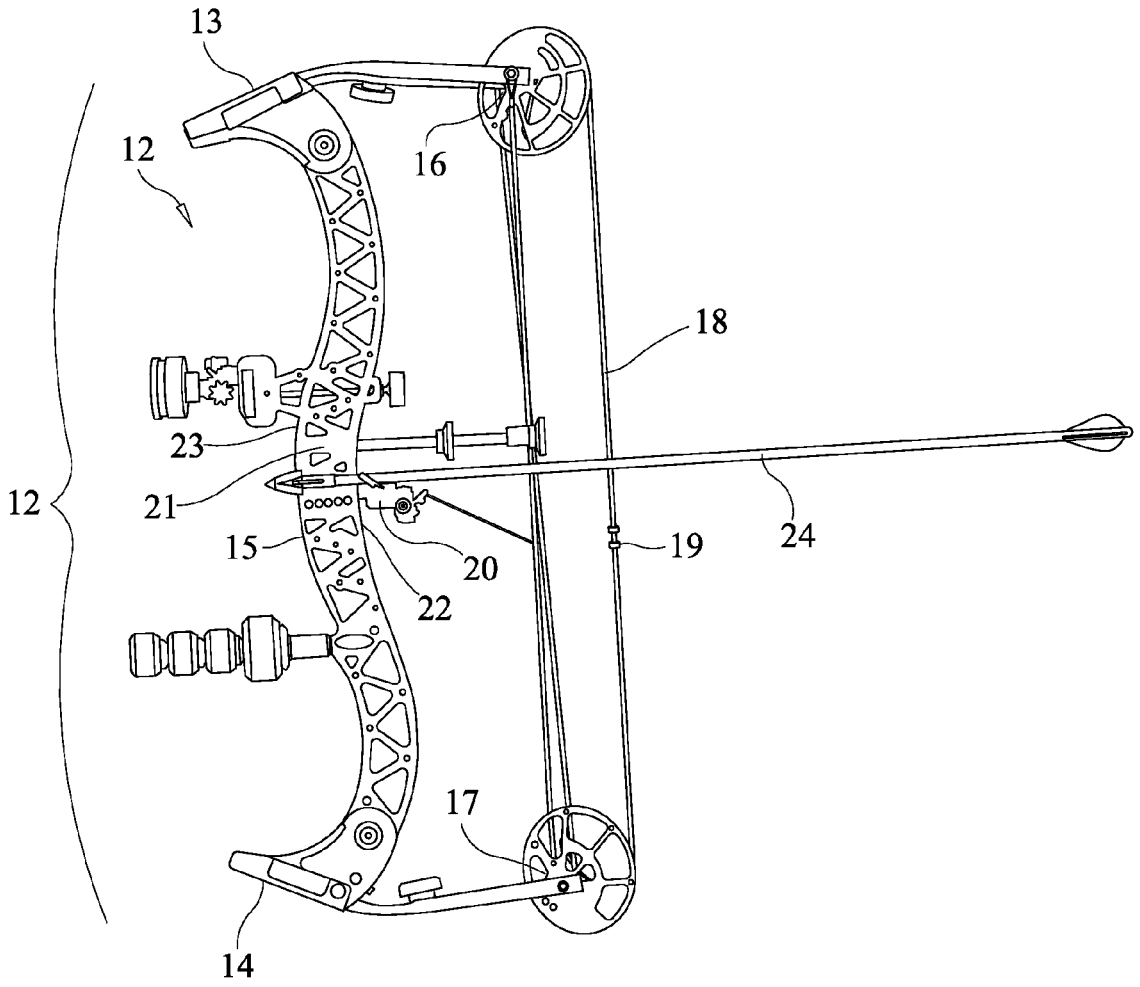
FIG. 1 shows a side view of a compound bow and the parts thereof.

"Arrow support member" is defined herein to include but be interpreted more broadly than an arrow rest and means anything that may support an arrow when nocked to a bow string. Referring to the drawings, FIG. 1 illustrates a bow 12, consisting of an upper limb 13, a lower limb 14, a bow riser 15 having an inner sidewall 21 and an outer sidewall 23 and a front wall 22, an upper limb pocket 16, a lower limb pocket 17, bow string 18, string nock or nock point 19, and an arrow rest 20. An arrow 24 may rest upon the arrow rest 20.

Figure 2A:
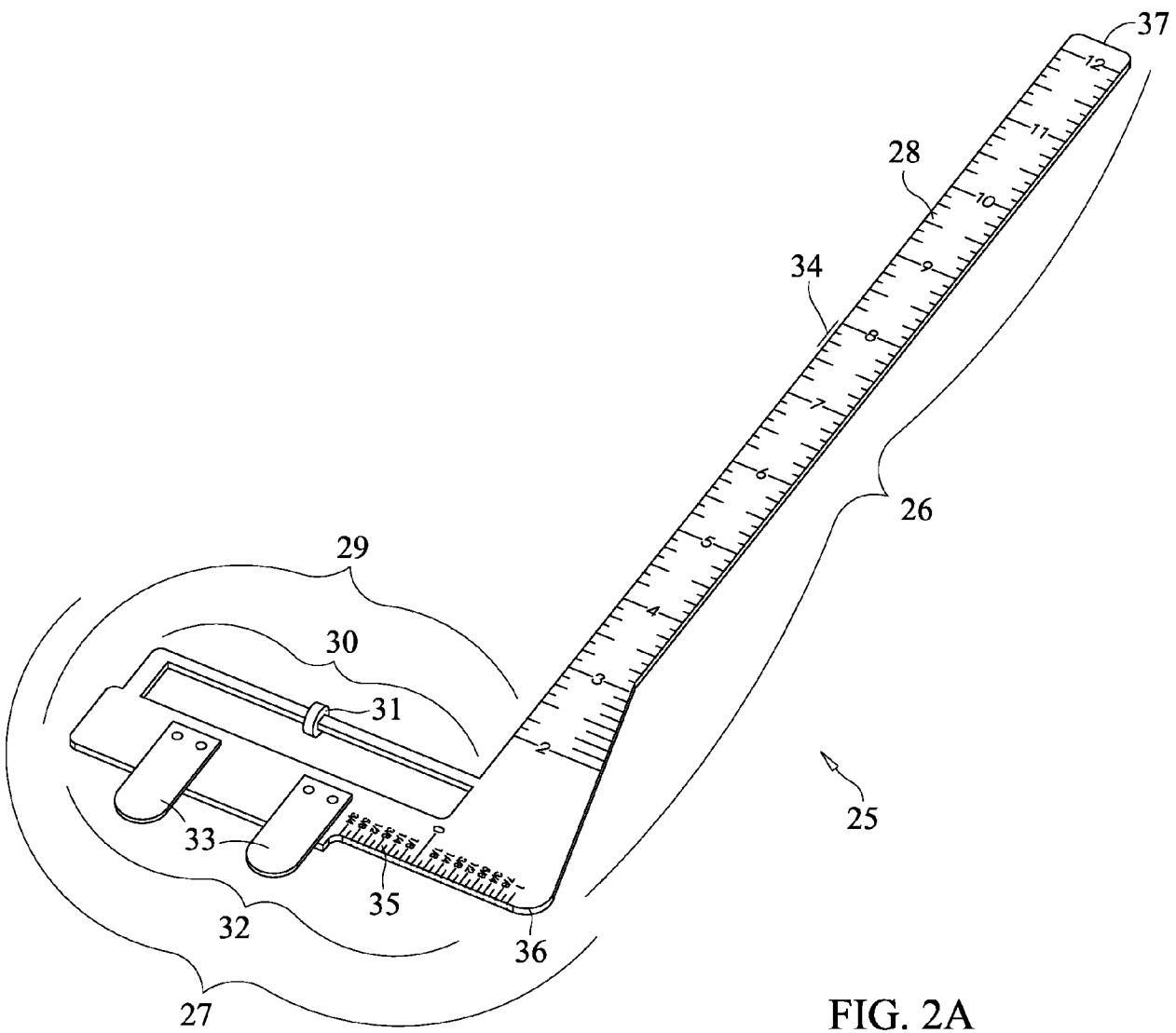
FIG. 2(*a*) shows a side perspective view of an embodiment of a device for centering an arrow to a bow comprising a bow square having a position marking means comprising a sliding bead.

FIG. 2(*a*) illustrates one embodiment of a device 25 for calibrating the center shot. The embodiment of the device 25 may comprise an L-shaped planar member having an elongated first member 26 and a second member 27 at one end of the first member 26, the first member 26 perpendicular to and longer than the second member 27. The first member 26 may comprise an inside edge 34, and first member scaled measurement markings 28. The second member 27 may comprise a means for marking a transverse position, which means in the embodiment of the device 25 illustrated in FIG. 2(*a*) may be an aligning component 29, the aligning component 29 comprising in one embodiment a cross bar 30 along which a piece or bead 31 may move.

The second member may have an outer side portion 32 comprising releasably securing means such as protruding clips or clamps 33. The second member outer side portion 32 may also comprise in the embodiment shown second member outer side portion scaled measurement markings 35. In one embodiment, along the outside edge of the corner of the "L" where the first member 26 and the second member 27 meet, may be a rounded corner, which may protrude slightly—herein referred to as the teardrop 36, which might be useful in verifying positions of the embodiment of the device 25 in relation to the bow 12.

Figure 2B:
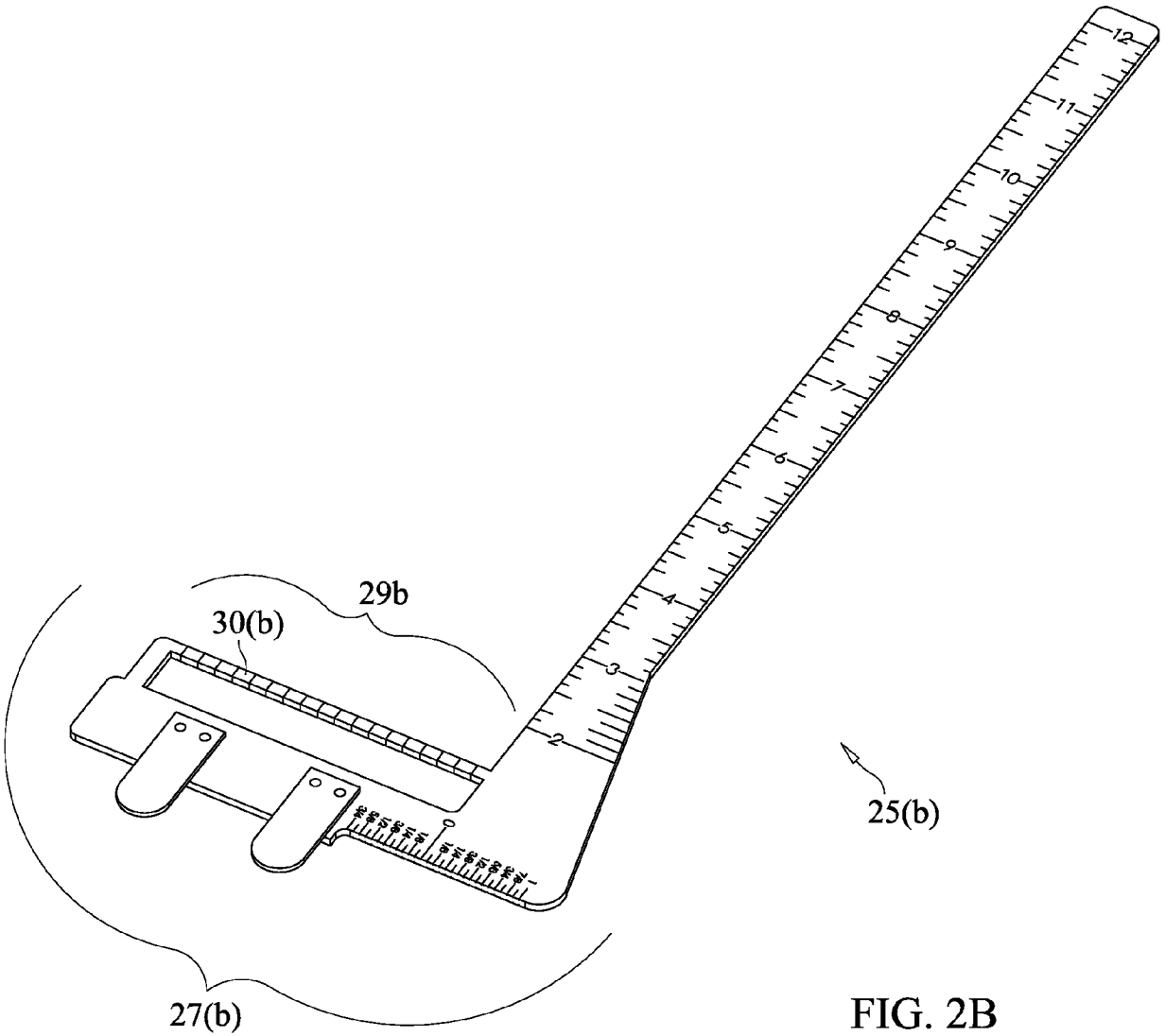

The means for marking a transverse position may vary in different embodiments. For example, the second member 27(*b*) of a different embodiment of the device 25(*b*), as shown in FIG. 2B, may comprise a means for marking a transverse position that bears scaled measurement markings 29(*b*) on an inner side portion of the second member 27(*b*), which inner side portion in the particular embodiment shown in FIG. 2(*b*) may comprise a cross bar 30(*b*).

Figure 3:
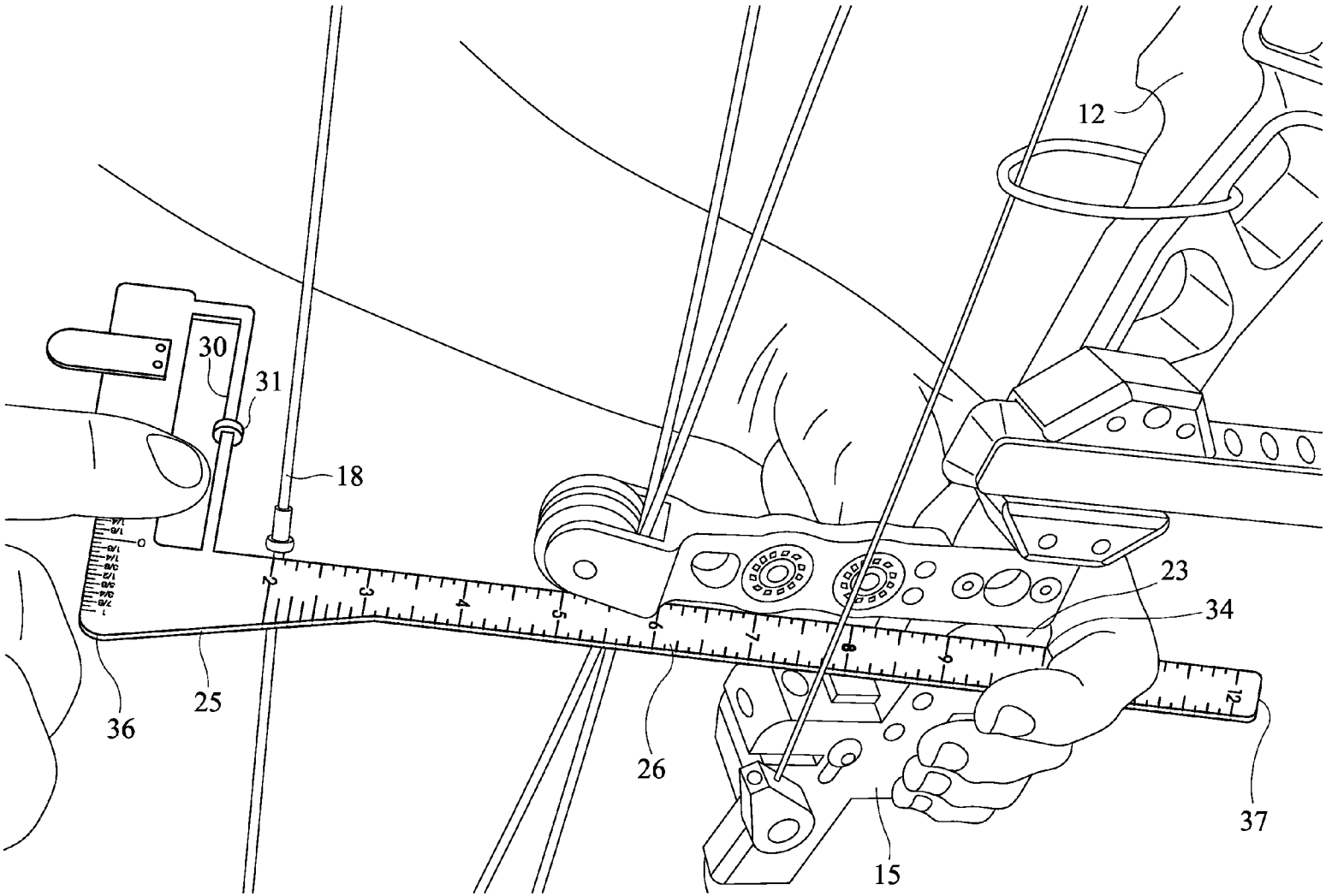
FIG. 3 shows a side perspective view of a portion of the bow of FIG. 1 and the embodiment of the device of FIG. 2(*a*) being used to mark the transverse position of the bow string.

FIG. 3 shows a side perspective of a portion of the bow 12, with the embodiment of the device 25 being used to calibrate the center shot of the bow 12. More specifically, the embodiment of the device 25 may be placed so that the cross bar 30 and bead 31 are posterior to the bow riser 15, and so that the first end 37 of the first member 26 points in the direction from the bow string 18 towards the bow riser 15, so that the inside edge 34 of the first member 26 (the edge on the long side of the first member 26 opposite from the teardrop 36) is placed flatly against the outer sidewall 23 of the bow riser 15. In other words, taking a rectangular cross section of the first member 26, the short side 34 of the rectangular cross section on the same side of the embodiment of the device 25 as the bead 31 on the cross bar 30, is against the outer sidewall 23 of the bow riser 15 in a level, contiguous manner, as also shown in the vertical perspective view of FIG. 4. In such a manner, the outer sidewall 23 of the bow riser 15 may be used as a reference point.

Figure 4:
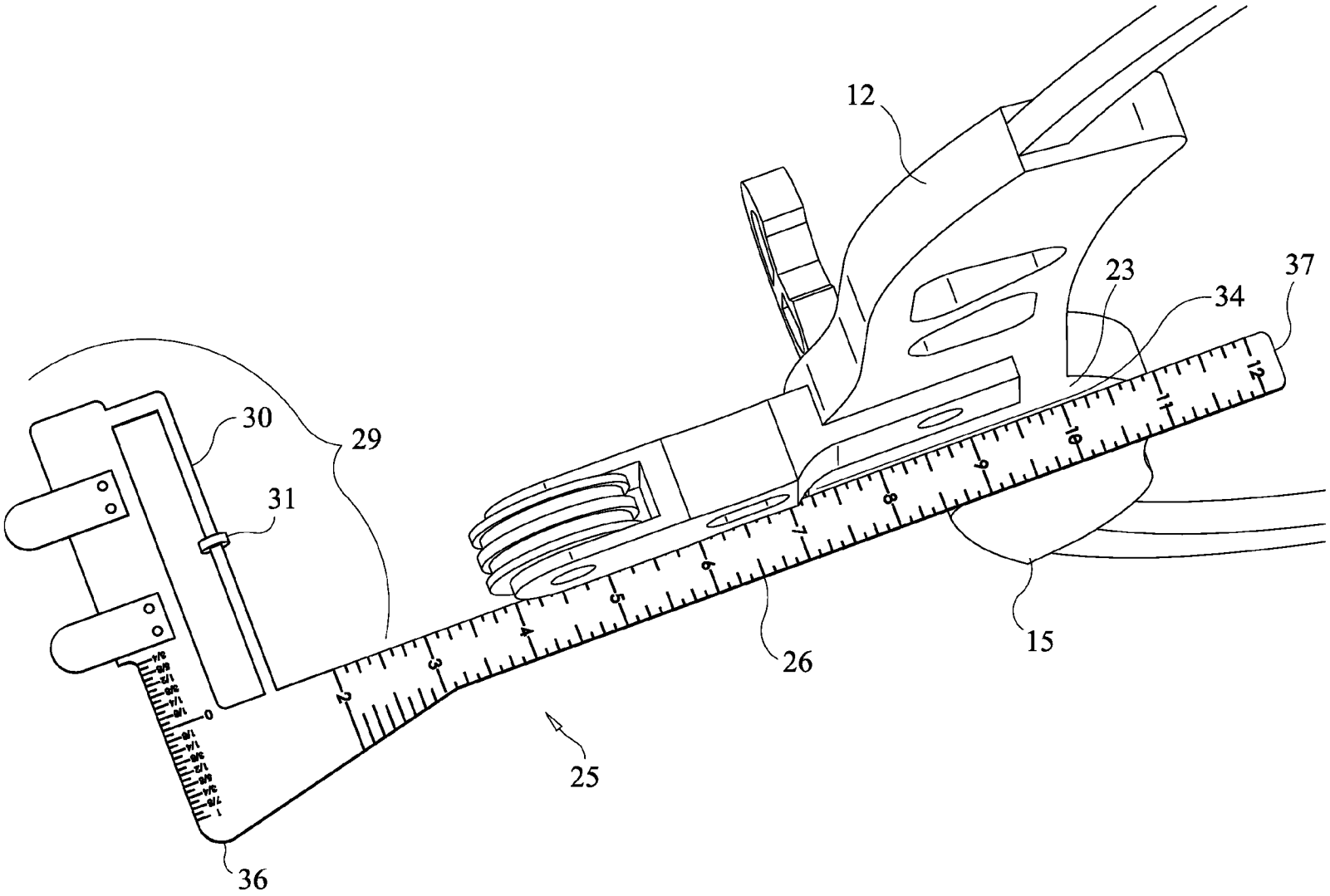
FIG. 4 shows a slight perspective overhead view of the bow of FIG. 1 and the embodiment of the device of FIG. 2(*a*) being used to mark the transverse position of the bow string.
Figure 5:
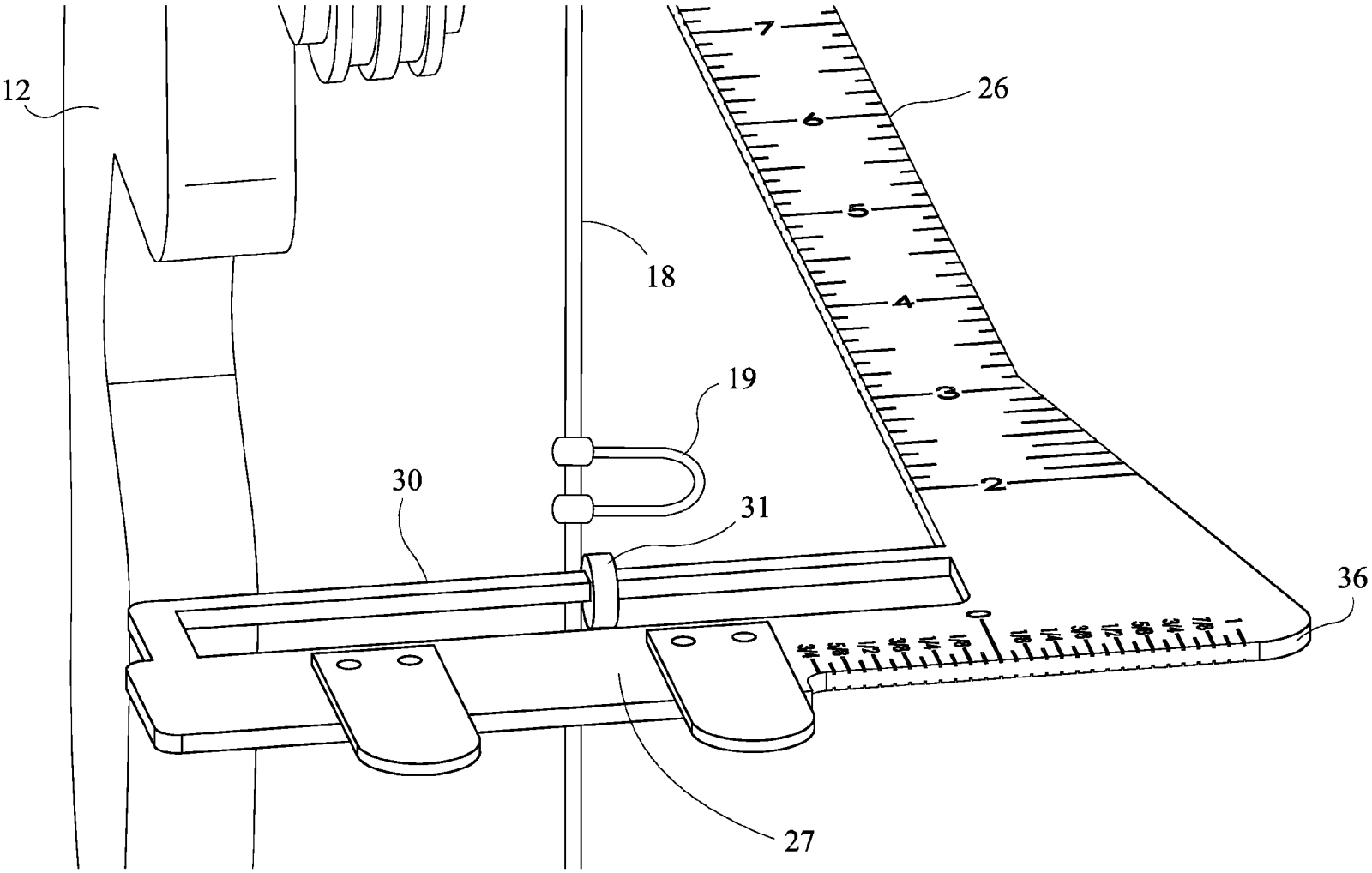
FIG. 5 shows a back perspective view of a portion of the bow of FIG. 1 and the embodiment of the device of FIG. 2(*a*) being used to mark the transverse position of the bow string.

With the inside edge 34 of the first member 26 against the outer sidewall 23 of the bow riser 15 in such a manner, (in the embodiment shown) the second member 27 is on the transverse plane of the vertically oriented bow 12 and bow string 18, as shown in FIG. 5. An aligning component 29 comprising, in the embodiment described herein, a cross bar 30 and a bead 31 that may move along the cross bar 30, may mark the transverse position of the bow string 18. More specifically, the embodiment of the device 25 shown in FIGS. 3 and 5 may mark the transverse position of the bow string 18, with the bead 31 moving along the cross bar 30 to a position corresponding to transverse position of the bow string 18, thereby measuring (in embodiment of the device 25 described herein) the transverse distance from the bow string 18 to the outer sidewall 23 of the bow riser 15 (as shown in FIGS. 3 and 4). The bead 31, furthermore, may remain temporarily fixed in a certain or any position along the cross bar 30 by means apparent to those skilled in the applicable art(s).

Figure 6:
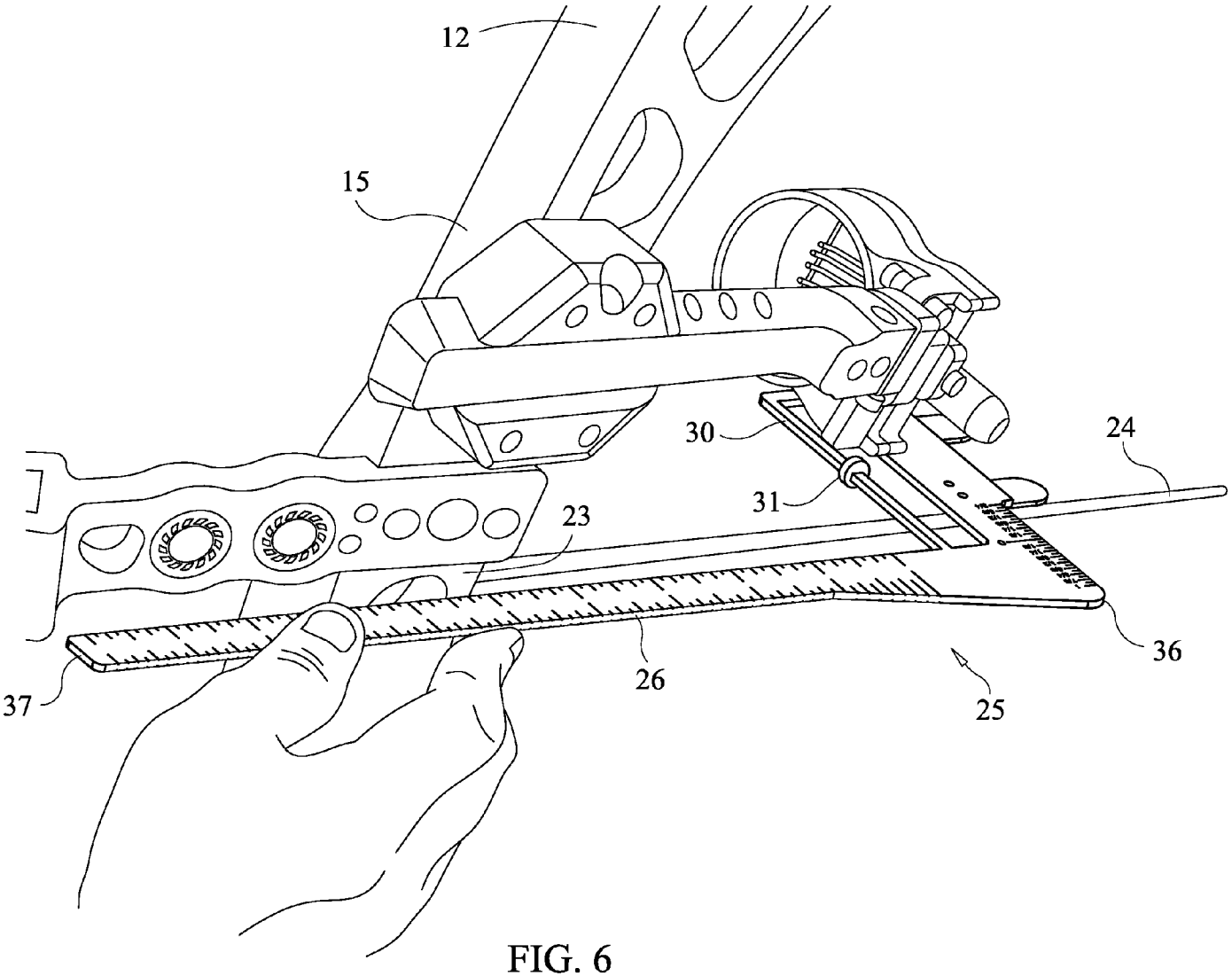
FIG. 6 shows a side perspective view of the bow of FIG. 1 and the embodiment of the device of FIG. 2(*a*) being used to center an arrow to the bow.
Figure 7:
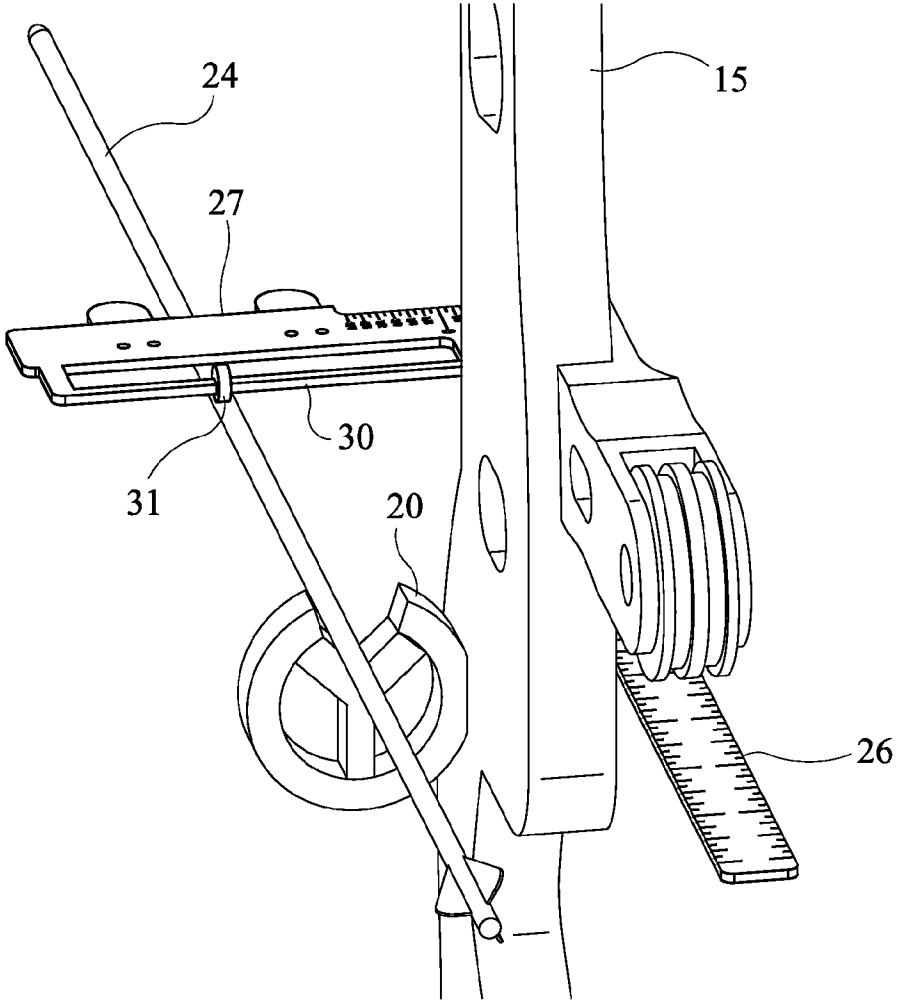
FIG. 7 shows a back perspective view of the bow of FIG. 1 and the embodiment of the device of FIG. 2(*a*) being used to center an arrow to the bow.
Figure 8:
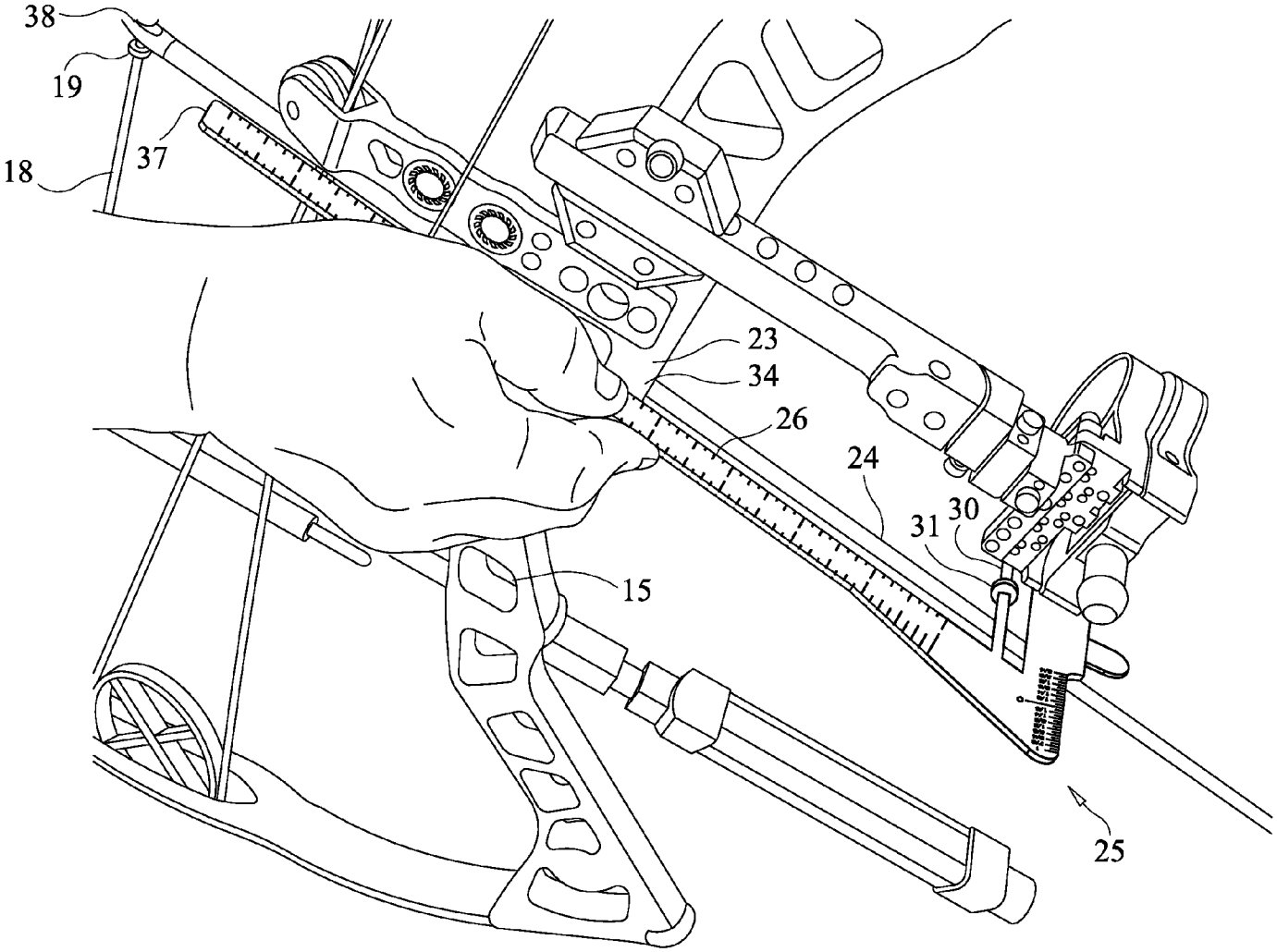
FIG. 8 shows a side perspective view of the bow of FIG. 1 and the embodiment of the device of FIG. 2(*a*) being used to center an arrow to the bow.

Once the transverse position of the bow string 18 has been marked using the transverse position marking means, which means comprises in the embodiment of the device 25 shown in FIGS. 2(*a*), 3, 4, and 5, an aligning component 29 comprising a cross bar 30 and a bead 31 configured to move along the cross bar 30, then, with the same inner edge 34 of the first member 26 (opposite from the tear drop 36) flatly against the outer sidewall 23 of the bow riser 15 (in a manner similar to that explained above where the surface of the inner edge 34 of the first member 26 and the surface of the outer sidewall 23 of the bow riser 15 are substantially contiguous, as shown in FIG. 6), the embodiment of the device 25 may be rotated about the latitudinal axis of the bow 12 until the first end 37 of the first member 26 points in the direction from the bow riser 15 toward the bow string 18 (as shown in FIG. 8), so that the cross bar 30 and aligning component 31 are still on the same side of the bow riser 15 as the arrow rest 20 (as shown in FIG. 7), but the cross bar 30 and aligning component 31 are now anterior to the bow riser 15 (from the viewpoint of an archer standing behind the bow string 18). As shown in FIG. 8, an arrow 24 may be placed on the arrow rest 20 with the back end of the arrow 38 touching the bow string 19 in a nocked position against the nocking point 19. Next, as shown in FIG. 7, in a manner known to the artisan (and depending on a particular bow brand and design), the arrow rest 20 may be adjusted so that the position/orientation of the arrow 24 (which may be resting on the arrow rest 20 and in a nocked position with the back end 38 of the arrow 24 against the nocking point 19 on the bow string 18) is aligned with (in the embodiment of the device 25 described herein) the position of the bead 31 along the cross bar 30 (i.e., the aligning component 29), which bead 31 may be fixed in a position along the cross bar 30 to mark the transverse position of the bow string 18. In this manner, using the outer sidewall 23 of the bow riser 15 as a reference point, and without requiring attaching to the bow 12 or any part thereof, the arrow 24 may be centered to the bow 12.

Figure 9:
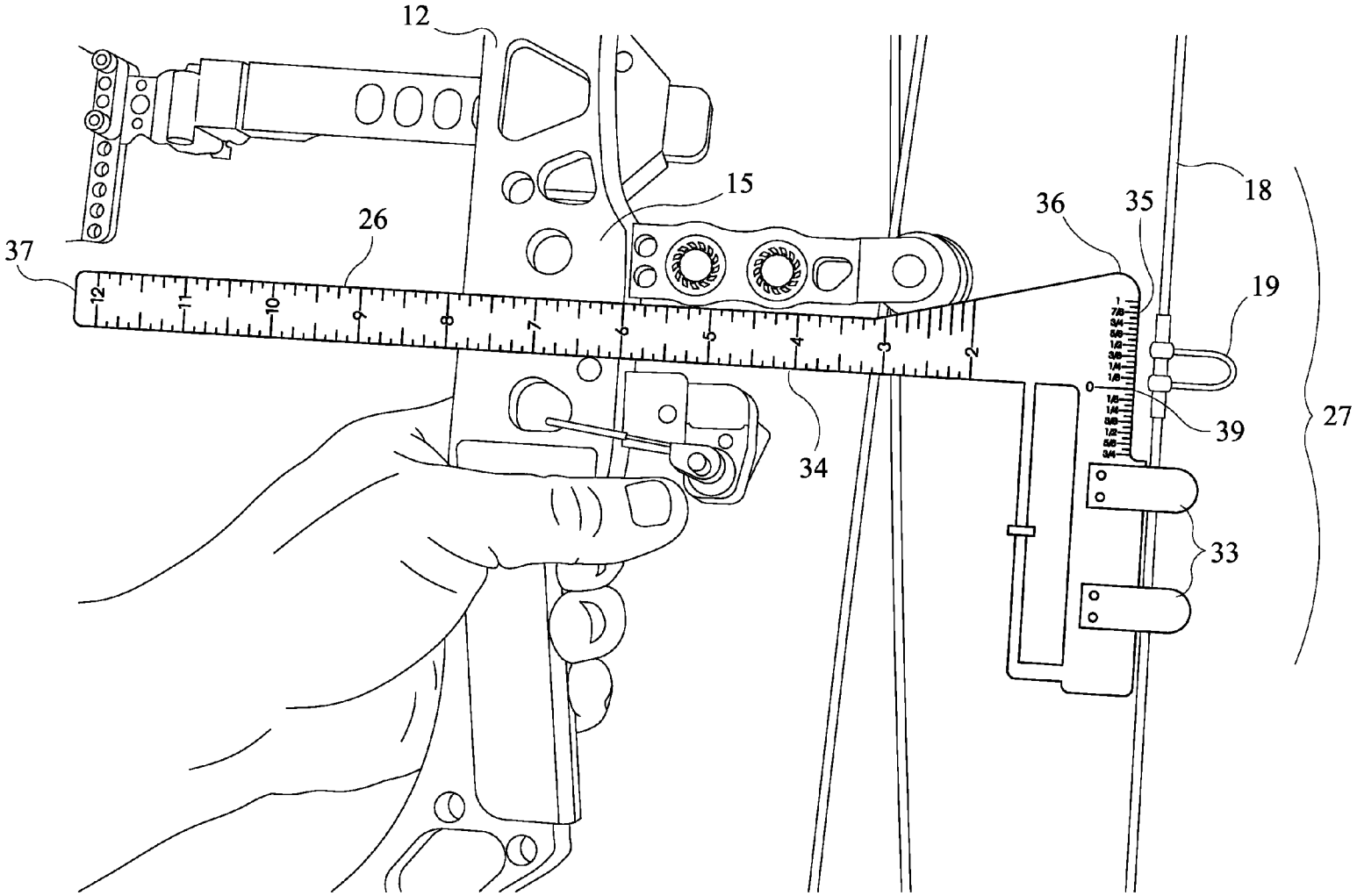
FIG. 9 shows a side perspective view of a central portion of the bow of FIG. 1, and the embodiment of the device of FIG. 2(*a*) being used to measure the nock height.

Although not required to constitute an embodiment of the device, in addition to assisting in calibrating center shot, the particular embodiments 25, 25(*b*) described herein may also be used to measure the nocking point 19 and brace height, to equalize the tiller distances, and to measure the peep sight. For example, FIG. 9 shows a close up side perspective view of a portion of the bow 12 and the embodiment of the device 25 being used to measure the nocking point 19. With the tear drop 36 facing up, or towards the upper limb 13, clamps 33 may secure the second member 27 to the bow string 18 (with the inside edge 34 of the first member 26 possibly resting even along the arrow rest 20). The second member scaled measurement markings 35 (and a zero point 39) may then be used to set the nock point 19 in a manner well-known to the skilled artisan.

Figure 10:
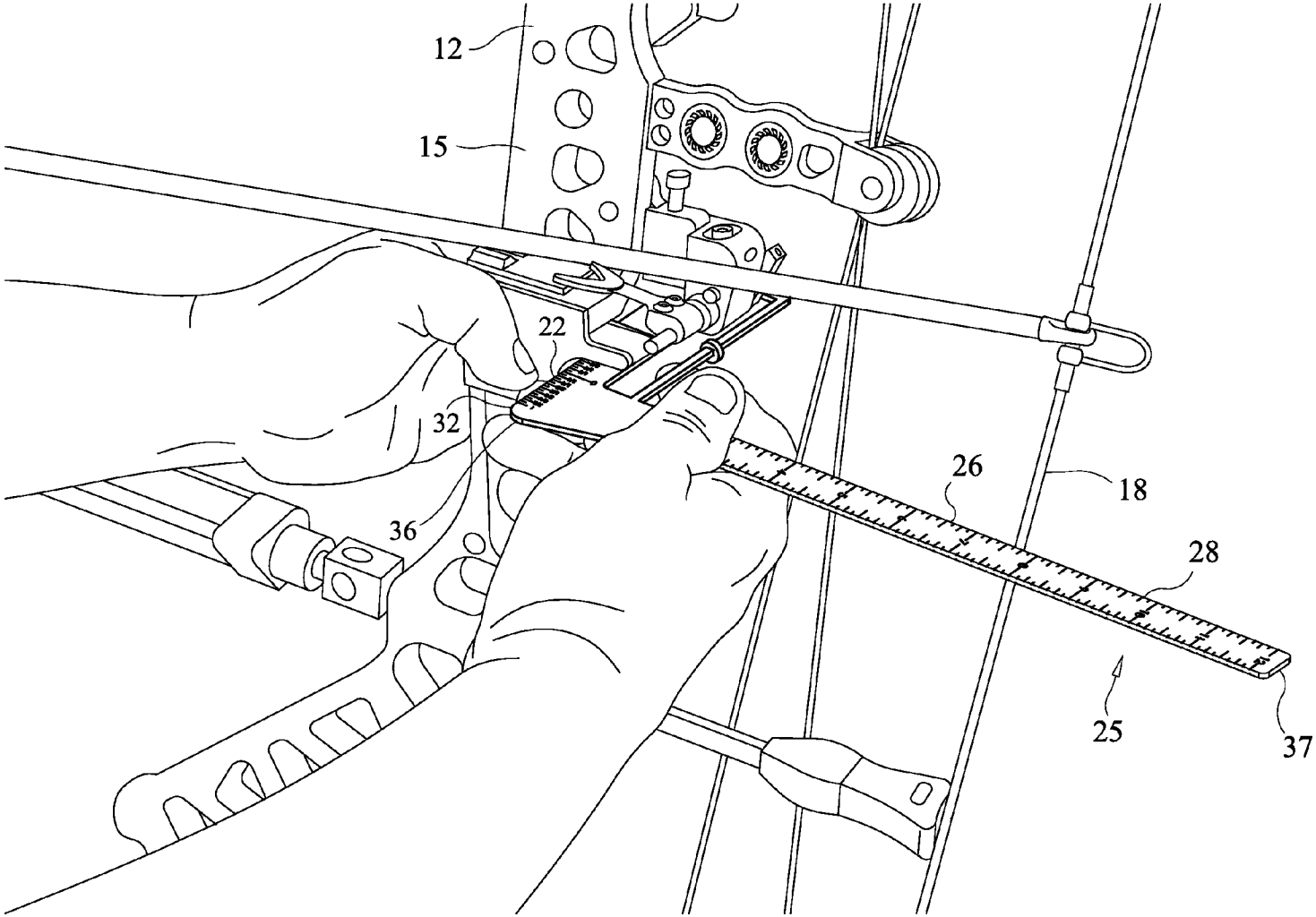
FIG. 10 shows a side perspective view of a portion of the bow of FIG. 1, and the embodiment of the device of FIG. 2(*a*) being used to measure the brace height.

FIG. 10 shows a close up side perspective view of a portion of the bow 12 and an embodiment of the device 25 being used to measure the distance from a front wall 22 of the bow riser 15 to the bow string 18, said distance being referred to as the brace height. With the second member outer side portion 32 (or at least the portion thereof located between the teardrop 36 and the clamps 33—said portion shown in FIGS. 11A and 11B) resting in a level manner against the front wall 22 of the bow riser 15 (also referred to as the front part of the bow handle, or pocket of the bow handle, or the side of the bow handle facing the bow string 18) so that the teardrop 36 faces horizontally away from the bow riser 15 and the first end 37 of the first member 26 points away from the bow riser 15 towards the bow string 18, although the first end 37 may pass beyond the bow string 18, allowing the brace height to be measured using the first member scaled measurement markings 28.

Figure 11A:
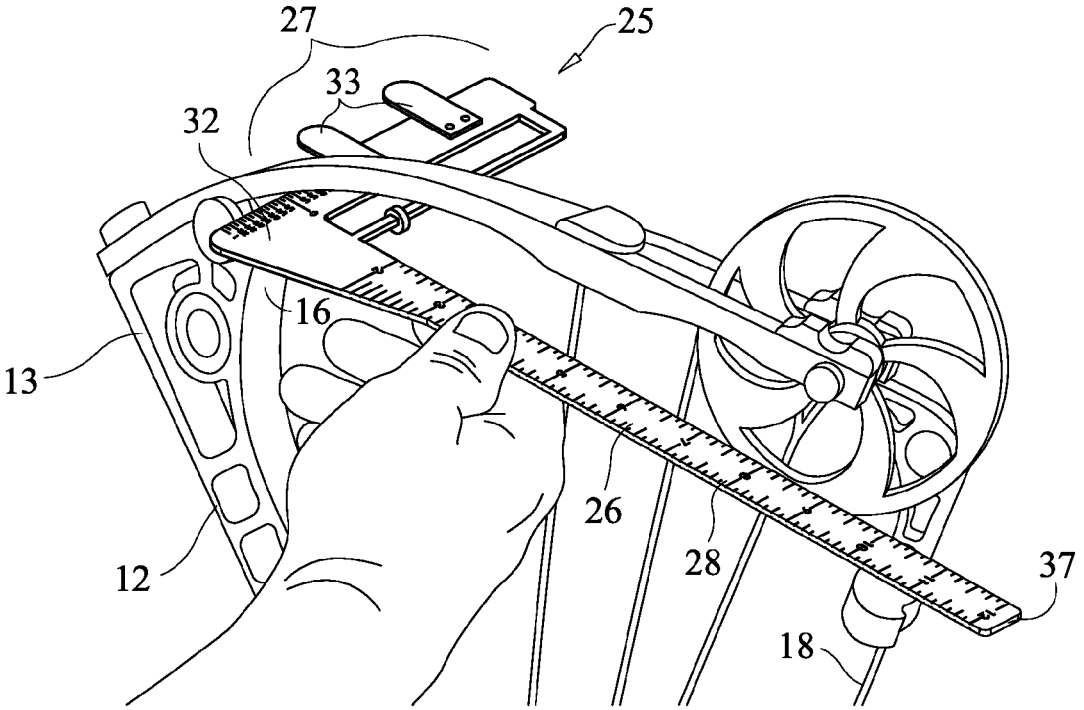
FIG. 11A shows a side perspective view of an upper limb portion of the bow of FIG. 1, and the embodiment of the device of FIG. 2(*a*) being used to measure the upper limb tiller distance.
Figure 11B:
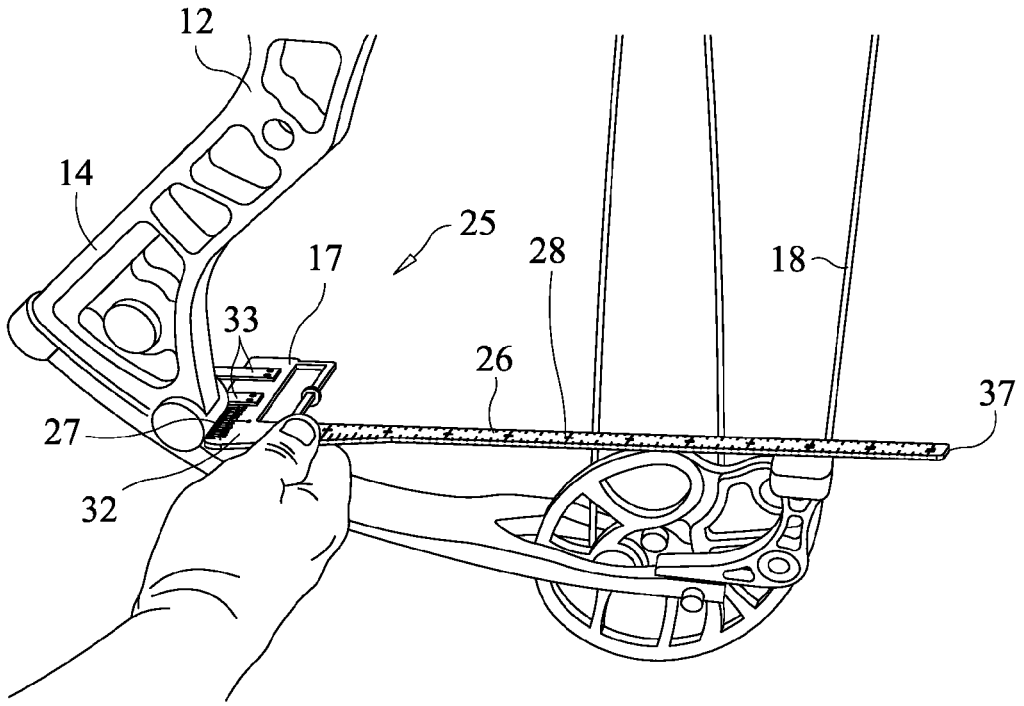
FIG. 11B shows a side perspective view of a lower limb portion of the bow of FIG. 1, and the embodiment of the device of FIG. 2(*a*) being used to measure the lower limb tiller distance.

FIGS. 11A and 11B show side perspectives of the upper limb 13 and bottom limb 14 portions (respectively) of the bow 12 and the embodiment of the device 25 being used to equalize the distances from the upper limb pocket 16 and the bow string 18, and from the lower limb pocket 17 and the bow string 18, said distances being referred to as the tiller distances. FIG. 11A shows the second member outer side portion 32 (or at least the portion thereof located between the teardrop 36 and the clamps 33) resting in a level manner against the upper limb pocket 16, in such a way that the teardrop 36 is facing horizontally away from the bow 12 and the first end 37 of the first member 26 pointing towards the bow string 18 and away from the upper limb pocket 16. FIG. 11B shows the second member outer side portion 32 (or at least the portion thereof located between the teardrop 36 and the clamps 33) resting in a level manner against the lower limb pocket 17, in such a way that the teardrop 36 is facing horizontally away from the bow 12 and the first end 37 of the first member 26 pointing towards the bow string 18 and away from the lower limb pocket 17. The first member scaled measurement markings 28 may then be used to measure tiller distances, with adjustments being made in a manner well-known to artisans for equalizing tiller distances.

Figure 12:
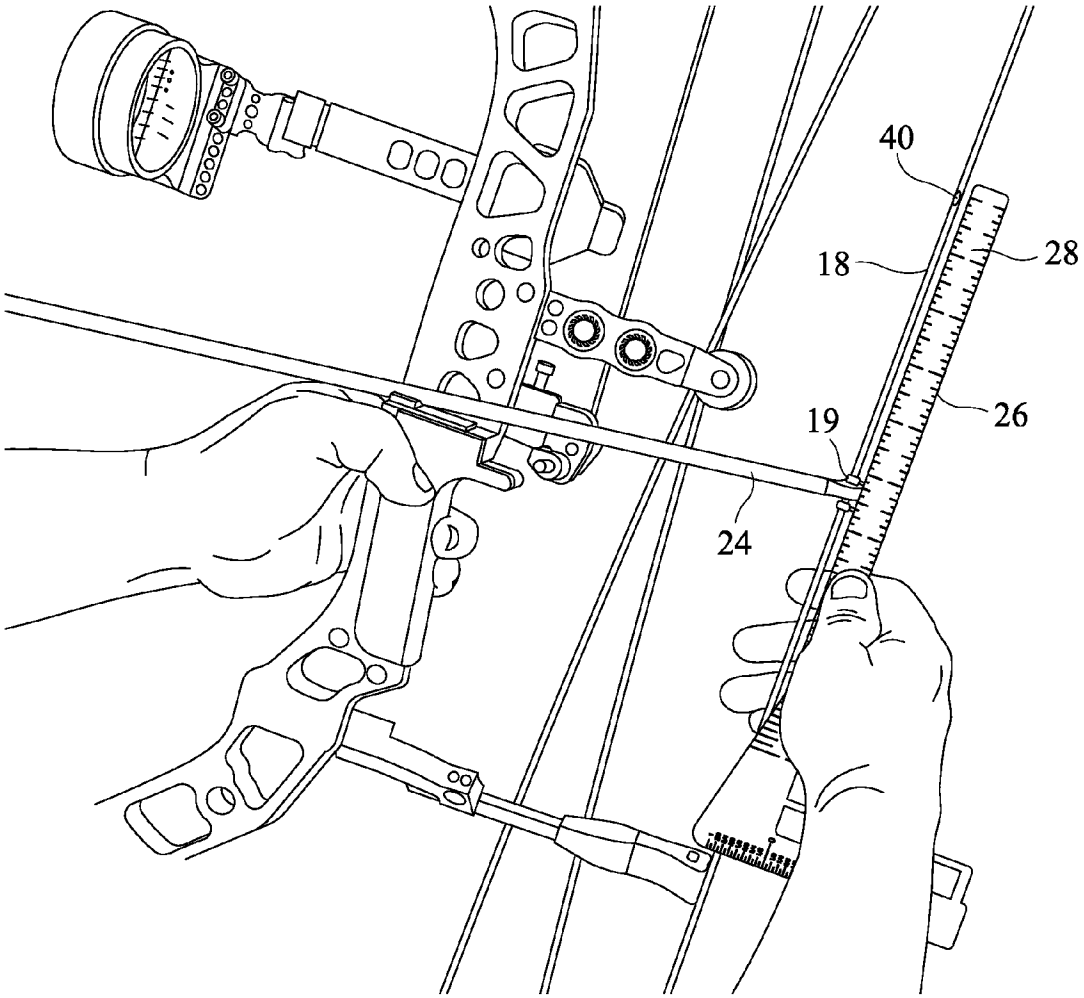
FIG. 12 shows a side perspective view of the bow of FIG. 1, and the embodiment of the device of FIG. 2(*a*) being used to measure distance to the peep sight.

An embodiment of the device 25 or 25(*b*) may also be used to measure the distance from the nocking point 19 to a peep sight 40, as shown in FIG. 12. Specifically, the first member scaled measurement markings 28 may be used to measure the distance from the nocking point 19 to the peep sight 40. Thus the embodiment of the device 25, in addition to assisting in calibrating center shot, may also be used to measure the nocking point 19 and brace height, equalize the tiller distances, and determine the location of the peep sight 40. An artisan may therefore use just one device (such as the embodiments of the device described herein 25 or 25(*b*)) to perform all the aforementioned calibrations.

I claim:

1. An archery device for marking an arrow nocking point in a vertical direction of a rearward bowstring of a bow and also for centering an arrow in a horizontal direction of the bowstring relative to a forward arrow support member of a bow, the bow being of the type having a bow riser supporting oppositely extending bow arms extending in opposite vertical directions with a bow string strung between the ends thereof and having an arrow nocking point markable at a desired vertical position thereon, the bow riser having an outer sidewall and adjoining step extending in a longitudinal direction from a rearward side to a forward side of the bow for an arrow to be aligned forwardly with an arrow shooting direction from the bowstring on the rearward side to an arrow support member at the forward side of the bow when nocked to the bow string, the position of the arrow support member being adjustable in the horizontal direction for centering an accurate shot of the arrow at a target, said archery device comprising:

a first member having a first length and inside and outside linear edges extending between opposite ends of the first length, wherein the outside linear edge of the first member is adapted to be aligned in the longitudinal direction in contact with the adjoining step of the outer sidewall of the bow riser, and the inside linear edge of the first member is adapted to be aligned in the longitudinal direction in contact with the outer sidewall of the bow riser;

a second member connected to one end of the first member extending in a transverse direction and having a second length and inside and outside linear edges extending in transverse direction at a right angle to the longitudinal direction of the first member, wherein the outside linear edge of the second member has an outer position scale for marking a desired arrow nocking point on the bow string when the first member is aligned in the horizontal direction in contact with the adjoining step of the bow riser and the second member is oriented in the vertical direction of the bow string, and the inside linear edge of the second member comprising an inner position scale for marking a transverse position of the bow string in the horizontal direction when the first member is aligned in the horizontal direction in contact with the outer sidewall of the bow riser and the second member of the device is turned to the horizontal direction for marking the position of the bow string in the horizontal direction on the rearward side of the bow;

wherein the outer position scale on the outside linear edge of the second member of the device comprises a linear series of index markings for measuring the desired arrow nocking point on the bow string in the vertical direction, wherein the inner position scale on the inside linear edge of the second member of the device comprises a cross bar connected between the second member and the first member and a bead marker for sliding and marking thereon, accurately and without the need for memorization, the position of the bow string in the horizontal direction on the rearward side of the bow so that the marked position of the bead marker on the cross bar can be used to adjust the position of the arrow support member in the horizontal direction for centering an accurate shot of the arrow at the forward side of the bow;

whereby the marked position of the bead marker on the cross bar of the inner position scale on the inside linear edge of the second member can then be used accurately and without memorization to adjust the arrow support member when the device is reversed from the rearward side to the forward side of the bow to align the first member with the outer sidewall of the bow riser and the second member extending in the horizontal direction at the forward side of the bow to locate an optimum position for the arrow support member corresponding to the marked position in the horizontal direction of the bow string for accurate center shot alignment.

2. The device of claim 1, wherein the first member has a first end, and the distance from the first end of the first member to the second member is greater than the distance from the bow string to the riser, and the length of the second member is greater than the distance from the outer sidewall of the bow riser to the transverse position of the bow string.

3. The device of claim 1, wherein the outside linear edge of the second member is provided with clips for releasably securing said device to the bow string.

* * * * *